US005168035A

United States Patent [19]

Lushington et al.

[11] Patent Number: 5,168,035

[45] Date of Patent: Dec. 1, 1992

[54] PROCESS FOR MAKING A PRESSURE FOG-RESISTANT PHOTOGRAPHIC ELEMENT

[75] Inventors: Kenneth J. Lushington, Rochester; Sucheta Tandon, Fairport, both of N.Y.

[73] Assignee: Eastman Kodak Company, Rochester, N.Y.

[21] Appl. No.: 634,449

[22] Filed: Dec. 27, 1990

[51] Int. Cl.[5] ..... G03C 1/015

[52] U.S. Cl. ..... 430/569; 430/603; 430/608

[58] Field of Search ..... 430/569, 603, 608

[56] References Cited

U.S. PATENT DOCUMENTS

| | | | |
|---|---|---|---|
| 3,320,069 | 5/1967 | Illingsworth | 96/107 |
| 4,177,071 | 12/1979 | DeBrabandere et al. | 430/494 |
| 4,247,620 | 1/1981 | Nagatani et al. | 430/264 |
| 4,495,277 | 1/1985 | Becker et al. | 430/567 |
| 5,017,468 | 5/1991 | Joly et al. | 430/569 |

FOREIGN PATENT DOCUMENTS

| | | | |
|---|---|---|---|
| 312959 | 4/1989 | European Pat. Off. . | |
| 340168 | 11/1989 | European Pat. Off. | 430/567 |

OTHER PUBLICATIONS

World Patents Index Latest, Section PQ, Week 4084, Derwent Publications Ltd., London GB; Class P83, AN84-247118 & JPA59149349 (Konishiroku Photo K.K.) 27, abstract.

Abstract of Japanese Patent 59-50438, Mar. 23, 1984.

Abstract of Japanese Patent 62-18538, Jan. 27, 1987.

*Primary Examiner*—Charles L. Bowers, Jr.

*Assistant Examiner*—Janet C. Baxter

*Attorney, Agent, or Firm*—Foley & Lardner

[57] ABSTRACT

A method for controlling pressure-induced fog in a silver bromide photographic material involves surface treatment of the emulsion AgBr grains with thiocyanate and an iodide salt. In particular, a process for making a pressure fog-resistant photographic emulsion includes steps of forming a photographic emulsion containing cubic or cubooctahedral silver bromide grains, surface-treating the AgBr grains with a thiocyanate by adding the thiocyanate to the emulsion, chemically sensitizing the emulsion, maintaining the emulsion at a temperature and for a time sufficient to allow the thiocyanate to react with the grain surfaces, and then surface-treating the AgBr grains with an iodide salt by adding the salt to the emulsion in an amount and under conditions effective to fill in cubic faces of the AgBr grains. The latter step partially or fully converts the AgBr grains to octahedral grains. A photographic element can then be made by coating the emulsion on a suitable base.

11 Claims, 3 Drawing Sheets

PROCESS FOR MAKING A PRESSURE FOG-RESISTANT PHOTOGRAPHIC ELEMENT

TECHNICAL FIELD

This invention relates generally to photographic silver halide materials, and, in particular, to a photographic material resistant to pressure-induced fog. The invention also relates to a method for control pressure-induced fog which is particularly suited for coarse-grained, cubooctahedral silver bromide emulsions.

BACKGROUND OF THE INVENTION

Silver halide crystals have been the dominant photosensitive material in photographic processes for more than a century. During this time, improvements in sensitivity have produced a broad range of materials with specialized photographic properties. Modern photographic emulsions consist of a very large number of tiny silver halide grains suspended in a polymeric matrix, typically gelatin. Such emulsions are prepared with silver chloride, bromide, or iodide, or with mixtures of these halides. When light of the appropriate wavelength, strikes the silver halide grains, a latent image is formed which corresponds to the visible image that appears upon photographic development.

The preparation of a photographic element generally includes the steps of precipitation, sensitization, and coating. The photographic properties or overall sensitivity of an emulsion are dependent upon several variables which may be controlled at various steps in the photographic process. Factors which influence sensitivity include the composition (proportion of halides), and the average size and morphology (shape) of the grains. The morphology of emulsion grains varies widely with the conditions of precipitation. In the precipitation step, grains of an emulsion are formed by mixing, in the presence of a protective colloid, solutions of a soluble silver salt and of one or more soluble halides. The method, rate and conditions of this precipitation step control, in large part, grain structure, size and distribution.

Some emulsions also require the presence of other substances in the precipitation solutions. For example, U.S. Pat. No. 3,320,069 issued May 16, 1967 to Illingsworth, describes an emulsion with low internal sensitivity prepared by precipitation or pre-washing treatment of the silver halide with thiocyanate ions.

The shape of the grains tends to vary with composition. Silver chloride grains, for example, are usually cubic, while silver bromide grains are cubic, octahedral or cubooctahedral. In the formation of the latter, the boundary between cubic and octahedral depends, in large part, on the silver ion concentration of the precipitating conditions, generally reported as pAg ($-\log [Ag^+]$). Typically, cubic grains form at a lower pAg than octahedral grains. The presence of iodide increases the probability of forming grains with octahedral faces, and shifts the boundary to a lower pAg. At a fixed pAg, the grain shapes are progressively more octahedral as the amount of iodide in the emulsions is increased. See generally "The Theory of the Photograph Process," T. H. James, ed., 4th Ed., Macmillan Publishing Co., Inc. (1977) p. 94.

Sensitizers used in the sensitization step of the photographic process include sulfur-containing agents, noble metals, reducing agents and polymeric agents. Spectral sensitizers may also be added to make the silver halide grains more sensitive to longer wavelengths of light.

After sensitization, certain additives are used to prepare the emulsion for coating For example, surfactants are added to facilitate wetting and spreading of the emulsion of the support. Tetraazaindenes are added to reduce spontaneous development in unexposed regions, and aldehydes can be used to permit high temperature processing.

Pressure fogging is a persistent problem with many silver halide photosensitive materials. Pressure exerted on an silver halide emulsion can generate electrons through a mechanism not completely understood. Emulsion grains, similar to other inorganic crystals and crystallites, have crystal defects such as dislocations, and sufficient stress can generate mobile electrons within the grains. Such stresses can be induced by poor camera design, such as squeezing roller pairs or other guides, mishandling of film by folding or twisting, or other physical phenomena which stress the film prior to development. The silver halide grains cannot discriminate between pressure-induced electrons and photon (or light-) induced electrons. Consequently, pressure-induced fog often occurs as lines in a negative which resemble scratches.

Pressure fog is a response to applied stress that fogs (i.e., makes developable in a non-imagewise fashion) some fraction of the emulsion grains. Such pressure-fogging can occur, and degrade the photographic performance of the film, at any point in the film's use up until development. Pressure-fogging does not require any imagewise exposure to be detectable, but if such an exposure should occur, the effects of pressure-fogging will be apparent as areas in the image with abnormally high density (in the negative).

Pressure fogging is distinctly different from pressure desensitization. The latter requires an exposure to be detectable The application of stress to the film prior to exposure damages some fraction of the grains such that imaging efficiency is seriously degraded. This loss of efficiency in the stressed region translates to a diminished density (desensitization) in an exposed region of the film.

Several attempts have been described in the prior art that attend to the problem of pressure sensitivity. U.S. Pat. No. 4,177,071, issued Dec. 4, 1979 to DeBrabandere et. al., discloses radiographic emulsions substantially insensitive to formation of pressure marks upon rapid processing which consist of silver halide grains of diameter of at least 250 nm and hydrophilic colloid to silver halide ratio of 1.0. U.S. Pat. No. 4,495,277 issued Jan. 22, 1985 to Becker et. al. discloses emulsions with surface-sensitized grains having a core/shell structure that have improved behavior with respect to pressure, when tested by applying a pressure trace to the emulsion immediately after the beginning of development.

Still other prior art has called for the addition of certain compounds to avoid the effects of pressure. U.S. Pat. No. 4,247,620 issued Jan. 27, 1981 to Nagatani et. al. describes a silver halide photographic material for use in high-contrast photography which is resistant to pressure as measured by a folding of the film test by incorporating a quaternary ammonium, phosphonium or arsenium compound in the photographic material.

Japanese Patent 62-018538 reports pressure resistivity of an emulsion which includes thiocyanate. Japanese Patent 59-050438 discloses an emulsion with improved pressure properties which includes heterooyclic nitrogen and tellurium compounds. Japanese Patent 61-22641 describes an emulsion which has an anti-pressure property and is prepared from an ammonium compound as the silver halide solvent. Despite attempts to provide photographic emulsions which maintain photographic speed and developability, yet control pressure-fog, the art has not responded with a photosensitive material having features that adequately address these needs.

SUMMARY OF THE INVENTION

This invention provides a method for controlling pressure-induced fog in a silver bromide photographic material by surface treatment of the emulsion AgBr qrains with thiocyanate and an iodide salt. In particular, a process for making a pressure fog-resistant photographic emulsion according to the invention includes steps of forming a photographic emulsion containing cubic or cubooctahedral grains consisting essentially of silver bromide, surface-treating the AgBr grains with a thiocyanate by adding the thiocyanate to the emulsion, chemically sensitizing the photographic emulsion, maintaining the emulsion at a temperature and for a time sufficient to allow the thiocyanate to react with the grain surfaces, and then surface-treating the AgBr grains with an iodide salt by adding the salt to the emulsion in an amount and under conditions effective to fill in cubic faces of the AgBr grains, partially or fully converting the AgBr grains to octahedral grains. A photographic element can then be made by coating the emulsion on a suitable base.

According to a further aspect of the invention, a photosensitive element having improved pressure fog resistance which can be made by the disclosed process includes a support and a colloid-silver halide photographic emulsion coated on the support. The emulsion contains octahedral or cubooctahedral grains, the interior of which are made of AgBr and the exterior of AgBrI. AgBrI is deposited mainly on cubic faces of an underlying cubic or cubooctahedral AgBr grain, generally in an amount equivalent to several (e.g., 10) monolayers.

An advantage of the invention is control of pressure-induced fog without loss of photographic speed of the photosensitive material, or change in developability. The method of the invention is also simple and readily incorporated into the typical photographic process. Other advantages and a fuller appreciation of the specific adaptations, compositional variations, and physical attributes of the invention will be gained upon an examination of the following detailed description of preferred embodiments, taken in conjunction with the figures of the drawing.

DETAILED DESCRIPTION

Figure 1:
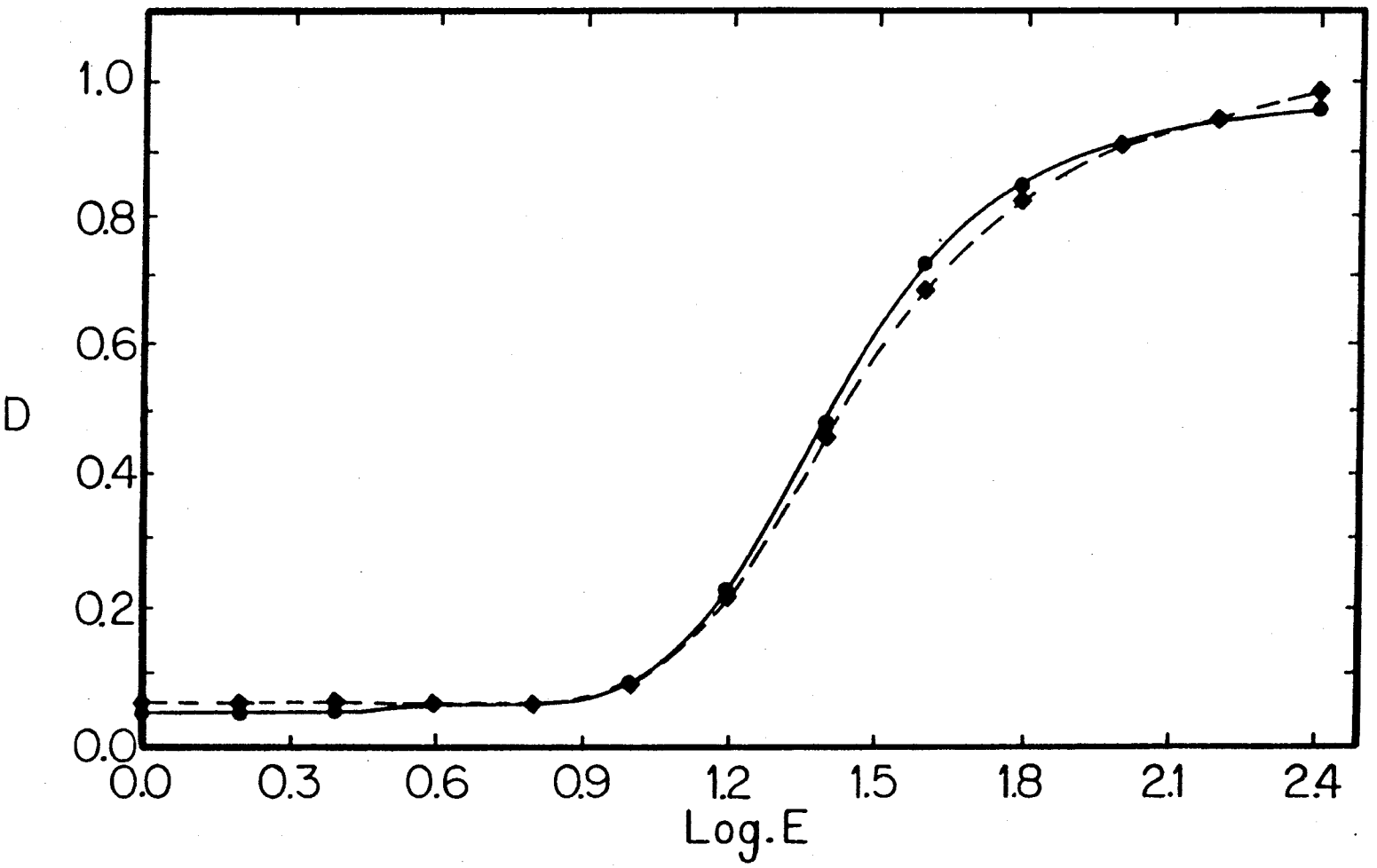
FIGS. 1 and 2 are graphs of normalized image density (D) versus relative exposure (log E) each comparing an emulsion which was subjected to a pressure test and a control emulsion not subjected to such a test.

A photographic film of the invention is characterized by an ability to resist sensitivity to mechanical pressure while maintaining photographic speed, gamma and developability. These attributes are achieved through treatment of the photographic emulsion with a combination of thiocyanate and iodide compounds. If pressure desensitization is not a concern, the thiocyanate treatment can be omitted. In the following description of the process of the invention, process steps are carried out at room temperature and atmospheric pressure unless otherwise specified.

A photographic element according to the invention may be prepared by first precipitating silver halide grains having substantially cubic or cubooctahedral structure in a colloidal matrix by precipitation methods known in the art. The colloid is typically a hydrophilic film forming agent such as gelatin, alginic acid, and derivatives thereof. The silver bromide is essentially pure AgBr or silver iodobromide with a low iodide content, e.g., so that the resulting AgBr grains contain generally not more than about 1 mole percent iodide. At higher iodide levels the process of the invention is generally less effective. The microcrystals formed in the precipitation step are of cubic or cubooctahedral shape. The process of the invention was not found effective when used on tabular AgBr grains.

The AgBr grains, after being precipitated and washed in a conventional manner, are surface-treated with a thiocyanate compound by direct addition of the compound to the emulsion. Suitable thiocyanate compounds include sodium thiocyanate, potassium thiocyanate and ammonium thiocyanate. The concentration of $SCN^-$ is in the range of about 10 mg to about 500 mg, preferably 25–200 mg, of $SCN^-$ per mole of silver. Amounts ranging from 0.15–10, particularly 0.4–3.5 millimoles thiocyanate per mole Ag are preferred, as illustrated in the examples below. In general, a lower amount of the thiocyanate may be used with smaller crystal sizes.

Chemical sensitization of the emulsion using other known sensitizers may also be effected as is known in the art. Such sensitizers include sulfur-containing compounds such as allyl isothiocyanate, sodium thiosulfate diethylselenide; and polymeric agents such as polyalkylene oxides. Of these, gold and sulfur-containing sensitizer compounds used in combination are most preferred. A finish modifier is also preferably added, for example, a benzathiazolium salt. Such sensitizers are generally added after the thiocyanate; the desired effects of the thiocyanate are sometimes absent when the other sensitizers are added first.

Following addition of the sensitizers, the emulsion is preferably ripened at an elevated temperature to maximize the effects of sulfur and gold sensitization. This involves heating the treated grains to a temperature in the range of 50° to 80° C. for at least about 5 minutes. The emulsion is then chill-set by cooling to a temperature in the range of 3° to 20° C.

The chilled emulsion is then remelted by heating to at least about 40° C., and the iodide salt is added, preferably all at once. The iodide salt may be KI, NaI, $NH_4I$, or another suitable salt, and is preferably added at a concentration between about 0.05 to 5 mole %, particularly 0.1 to 2 mole %, especially about 0.2 to about 1.0 mole % per mole silver. Amounts of iodide greater than 2 mole percent begin to degrade photographic performance (decrease Dmax). Below 0.05 mole %, there is essentially no change on the sensiometric curve. The emulsion may then be maintained at a temperature of at least about 40° C. for at least about 5 minutes to allow the iodide salt to react completely with the surfaces of the grains.

The emulsion can then be immediately coated on a support, or chilled and stored for later use. Suitable supports include cellulose esters, acetates or acetobutyrates, polyesters, polycarbonates, paper, glass or metal. Various coating techniques including dip coating, air knife coating, curtain coating and extrusion coating may be used. Other conventional coating addenda may be used in the preparation of the emulsion, such as surfactants, hardeners, and plasticizers.

The presence of KI in an effective amount limits and controls pressure-induced fog if the photographic emulsion is subjected to pressure stress prior to development. If $SCN^-$ is not added, the emulsion incurs significant pressure desensitization, i.e., significant loss of efficiency due to stress on the film.

The combined effect of KI addition according to the invention is to fully or partially convert the initial cubic or cubooctahedral structure of the AgBr grains to octahedral. Photomicrographs of the AgBr grains before and after treatment with KI and $SCN^-$ show that the edges of the cubooctahedral grains are made sharp, and the structure of the grains tends to look more like the pure octahedral configuration, i.e., there is epitaxial crystal growth on the cubic faces.

Pressure fogging problems increase with increasing size of the AgBr grains in the photosensitive element. Although pressure fogging problems can be minimized by using small grains, larger grains are necessary for higher-speed photographic performance and are prevalent in commercial use. The present invention is particularly effective for preparing emulsions containing larger AgBr-AgBrI grains, especially octahedral or cubooctahedral grains wherein the octahedral edge length is at least 0.5 micron, with edge lengths ranging from 1 to 5 microns being most common.

Accordingly, a photosensitive element according to the invention contains a silver bromide photographic emulsion wherein the grains are octahedral or cubooctahedral, and have an octahedral edge length of at least 0.5 micron, especially at least 1 micron. The interior of the grains is essentially AgBr, and the exterior is essentially AgBrI, the AgBrI being deposited mainly on cubic faces of the underlying cubic or cubooctahedral AgBr grain in a manner which improves pressure fog resistance while maintaining other desired performance characteristics. The resulting grains generally contain 0.2 to 2 mole % I and 98 to 99.8 mole % Br per mole Ag. At relatively low iodide levels, e.g. 0.05 to 0.2 mole % of the finished grain, photographic performance improves slightly. The cubic faces of the underlying AgBr grains are preferably surface treated with the thiocyanate prior to forming AgBrI thereon to improve the pressure desensitization resistance of the photographic element.

The invention will be further explained by way of the following examples, which should not be construed to limit the scope of the invention.

EXAMPLE 1

A 1.8 μm cubooctahedral AgBr grain emulsion was precipitated by a double jet precipitation procedure as follows. A well-stirred 2.0 wt. % gelatin solution, containing 1.2 gm of 1,4,10,13-tetraoxa-7,16-dithiacyclooctadecane, was first prepared. 50 ml each of 0.4 M $AgNO_3$ and 0.4 M NaBr were added at a rate of 100 ml/min for 0.5 minutes by double jet addition to 4.0 liters of the foregoing gelatin solution controlled at a pAg of 8.4 and a temperature of 70° C. After nucleation, the solutions were switched to 4M $AgNO_3$ and 4M NaBr and added by double jet in an accelerated flow from 10 ml/min to 80 ml/min in 25 minutes. At this point the flow rate was held constant at 80 ml/min for 15 minutes to complete the precipitation. The temperature was then reduced to 40° C. and the emulsion washed following the procedure of U.S. Pat. No. 2,614,929. The concentration of gelatin was adjusted to 40 grams/mole Ag, and the emulsion was stored for use. The resultant cubooctahedral emulsion had an effective octahedral edge length of 1.8 microns.

This emulsion was optimally chemically sensitized by addition of sodium thiocyanate (1.7 mmole/mole Ag), sodium thiosulphate (18.0 μmole/mole Aq), potassium tetrachloroaurate (6.0 μmole/mole Ag), and a benzathiazolium salt (0.02 mmole/mole Ag) as a finish modifier having the formula:

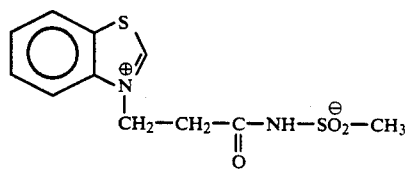

The sensitizers were added a few minutes apart in the order specified. Chemical ripening was allowed to occur during a heat ramp from 40° C. to 65° C. at 1.66° C./min, held for 20 minutes. The emulsion was chilled and stored at 4° C. Once sensitized, separate Samples IA-lE of the emulsion were remelted and treated with varying levels of potassium iodide (added all at once) at 40° C., and held for 20 minutes.

The sensitized emulsions were coated on a 5 mil cellulose acetate base with 450 mg/ft$^2$ silver and 900 mg/ft$^2$ gelatin. The coatings were hardened at 1.5% of the total gelatin content with bis(vinylsulfonyl) methane. Samples were then stressed with a roller pressure device. The coatings were tested for their response to applied stress by passing the samples between two rollers. The level of stress applied to the film was controlled by adjusting the force applied to the top roller. One of the rollers was roughened so as to mimic the situation encountered, for example, with dirty transport rollers.

Once each film was stressed, it was exposed through a 0–4 density step tablet for 0.01 sec at an intensity sufficient to reach Dmax Samples were processed for 6 minutes in a hydroquinone-Elon (N-methyl-p-aminophenol-hemisulphate) developer. Densities were read in both the stressed and non-stressed regions of each coating. The difference in developed density between these two regions was used to characterize the pressure sensitivity. The iodide levels and results are shown in Table 1.

TABLE 1

| Sample - I Level (mol %/mol Ag) | Relative Speed | Pressure-Fog | Pressure Desensitization |
|---|---|---|---|
| 1A - 0.0 | 100 | 0.29 | None |
| 1B - 0.2 | 107 | 0.13 | None |
| 1C - 0.5 | 100 | 0.06 | None |
| 1D - 1.0 | 86 | 0.04 | Low |
| 1E - 1.5 | 73 | 0.04 | Moderate |

Iodide levels in the range of about 0.5 to 1.0 proved most effective at suppressing pressure fog without causing pressure desensitization.

EXAMPLE 2

The procedure of the first paragraph of Example 1 was repeated to prepare an unsensitized cubooctahedral emulsion. This emulsion was chemically sensitized by addition of sodium thiosulphate (18.0 μmole/mole Ag), potassium tetrachloroaurate (6.0 μmole/mole Ag), and the same benzathiazolium salt used in Example 1 (0.2 mmole/mole Ag). Chemical ripening was allowed to occur during a heat ramp at a rate of 1.66° C./min from 40° C. to 65° C., and then holding at 65° C. for 20 minutes. Once sensitized, Samples 2A and 2B of the emulsion were treated with varying levels of potassium iodide at 40° C. and held for 20 minutes. Samples were then coated, stressed, exposed and processed as in Example 1. The potassium iodide levels used and the results are given in Table 2.

TABLE 2

| Sample - I Level (mol %/mol Ag) | Relative Speed | Pressure-Fog | Pressure Desensitization |
|---|---|---|---|
| 2A 0 | 70 | 0.17 | None |
| 2B 0.5 | 70 | 0.01 | Severe |

Absent the thiocyanate, addition of the iodide still reduces pressure fog, but pressure desensitization also occurs.

EXAMPLE 3

The procedure of the first paragraph of Example 1 was again repeated to prepare an unsensitized cubooctahedral emulsion. This emulsion was chemically sensitized by addition of sodium thiocyanate (0.9 mmole/mo-le Ag), sodium thiosulphate (18.0 μmole/mole Ag), and potassium tetrachloroaurate (3.0 μmole/mole Ag). Chemical ripening was allowed to occur during a heat ramp at a rate of 1.66° C./min from 40° C. to 65° C., and then holding at 65° C. for 20 minutes. Once sensitized, the emulsion was treated with varying levels of potassium iodide at 40° C. and held for 20 minutes. Samples were then coated, stressed, exposed and processed as in Example 1. The potassium iodide levels used and the results are given in Table 3.

TABLE 3

| Sample - I Level (mol %/mol Ag) | Relative Speed | Pressure-Fog | Pressure Desensitization |
|---|---|---|---|
| 3A 0 | 30 | 0.15 | None |
| 3B 0.5 | 30 | 0.02 | None |

Results are comparable to the results of Example 1. Example 3 shows that, while the benzathiazolium compound is necessary for speed (Example 1, speed 100; Example 3, where it is absent, 30) it does not affect the efficacy of the SCN/KI treatment. The overall lower pressure fog in both the control and treated samples in Example 3 is due to the resulting lower speed.

Figure 2:
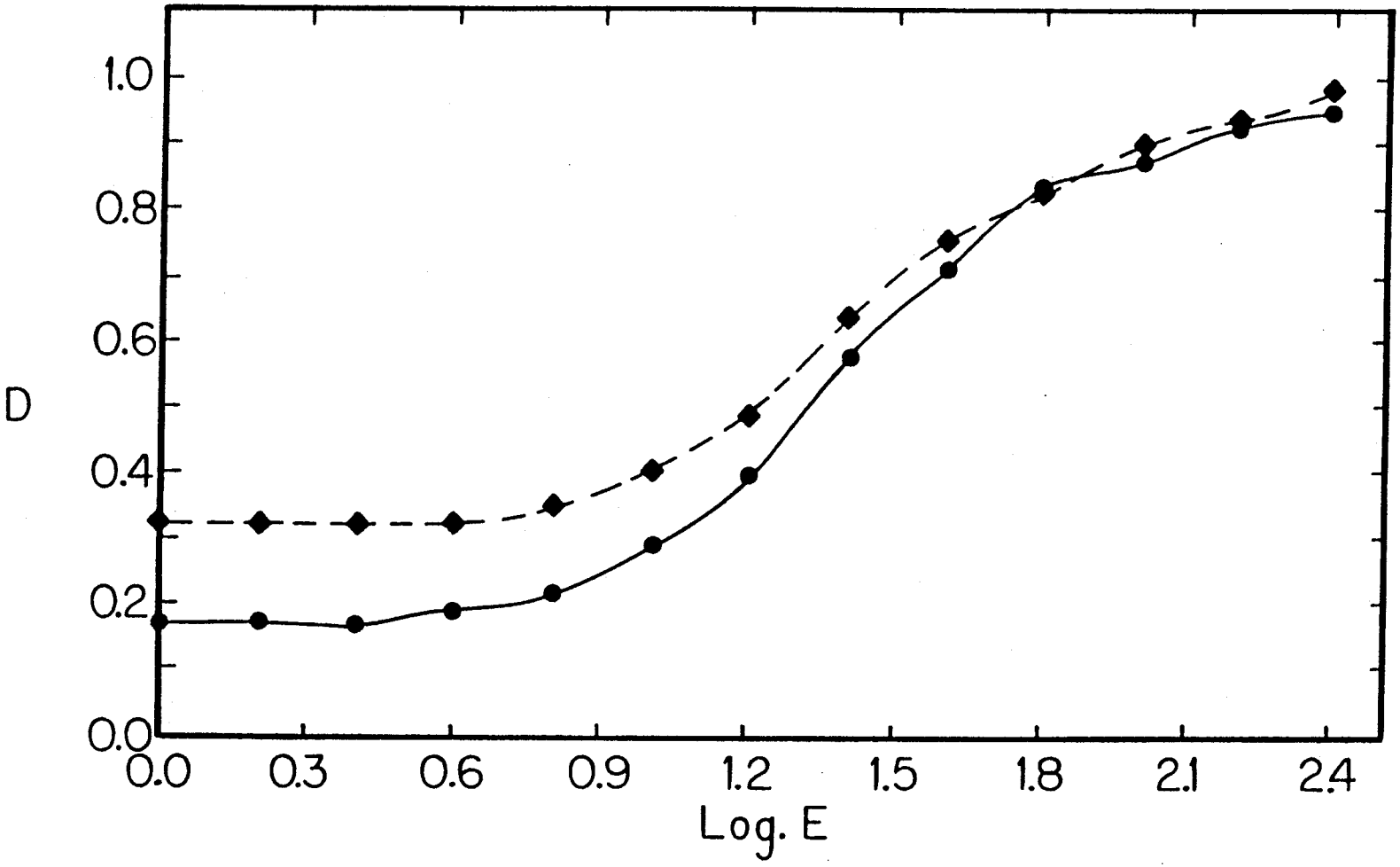

FIG. 1 compares the image density obtained when the film 3B of this example was stressed (diamonds) and not stressed (circles). Little change in the curve occurred. FIG. 2 similarly compares the image density obtained when the film 3A of this example was stressed (diamonds) and not stressed (circles). The results show a large increase in background density for the comparative film 3A lacking iodide.

Figure 3:
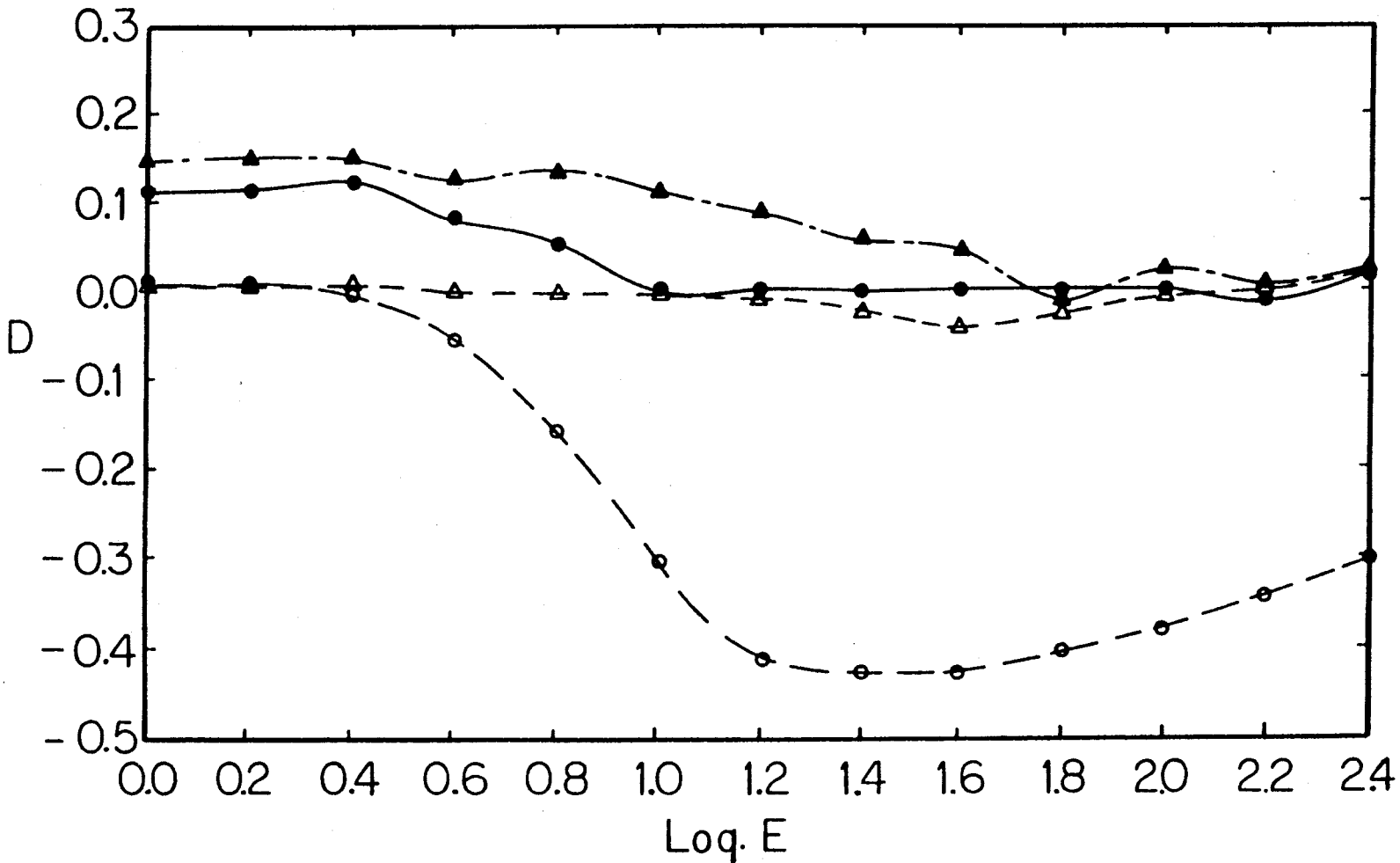
FIG. 3 is a graph of pressure induced change in density (D) versus exposure (log E) illustrating the effect of thiocyanate ion in accordance with the method of the invention.

FIG. 3 illustrates the effect of thiocyanate concentration on pressure induced density changes at varying levels of exposure. Solid circles represent the film 2A of Example 2, open circles film 2B of Example 2, solid triangles film 3A of this example, and open triangles film 3B of this example. The change in density induced by pressure was determined and plotted versus relative exposure for emulsion sample 2A having neither thiocyanate nor KI treatment, sample 3A having only thiocyanate treatment, sample 2B having only KI treatment, and sample 3B having both thiocyanate and KI treatment.

The results demonstrate the surprising effect of treatment with both thiocyanate and KI, i.e., the pressure-induced change in density remained virtually constant as a function of relative exposure. Of the remaining samples, 2A and 3A lacking the iodide treatment suffered from pressure fog effects, whereas 2B suffered from pressure desensitization, i.e., a negative pressure-induced density change occurred at higher exposures.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

We claim:

1. A process for making a pressure fogresistant photographic element, comprising the steps of:
   (A) forming a photographic emulsion containing cubic or cubooctahedral grains consisting essentially of silver bromide;
   (B) surface-treating the AgBr grains with a thiocyanate by adding the thiocyanate to the emulsion;
   (C) chemically sensitizing the photographic emulsion;
   (D) maintaining the emulsion at a temperature and for a time sufficient to allow the thiocyanate to react with the grain surfaces; then
   (E) surface-treating the AgBr grains with an iodide salt by adding the salt to the emulsion in an amount and under conditions effective to fill in cubic faces of the AgBr grains, partially or fully converting the AgBr grains to octahedral grains; and
   (F) coating the emulsion on a base to form a photographic element.

2. The process of claim 1, wherein the thiocyanate is used in a concentration of about 0.15 to 10 mmoles thiocyanate per mole silver, and the iodide salt is used in a concentration of about 0.05 to about 5 mole percent per mole silver.

3. The process of claim 1, wherein the thiocyanate is used in a concentration of about 0.4 to 3.5 mmoles thiocyanate per mole silver, and the iodide salt is used in a concentration of about 0.1 to about 2.0 mole percent per mole silver, the thiocyanate is sodium thiocyanate, potassium thiocyanate or ammonium thiocyanate, and the iodide salt is KI or NaI.

4. The process of claim 2, wherein said thiocyanate is sodium thiocyanate, potassium thiocyanate or ammonium thiocyanate, and said iodide salt is KI, NaI, or $NH_4I$.

5. The process of claim 1, wherein said AgBr grains in steps (A) and (B) contain up to about 1 mole % iodide in place of bromide.

6. The process of claim 1, wherein the grains present in step (F) have an edge size of at least about 1 micron.

7. The process of claim 4, wherein step (C) comprises treating the grains with sensitization-effective amounts of sulfur and gold.

8. The process of claim 7, wherein step (D) further comprises heating the treated grains to a temperature in the range of 50° to 80° C. for at least about 5 minutes, then chill-setting the emulsion; and step (E) further comprises heating to remelt the chilled emulsion, then adding the iodide salt thereto, and then maintaining the emulsion at a temperature of at least about 40° C. for at least about 5 minutes.

9. The process of claim 1, wherein step (D) further comprises heating the treated grains to a temperature in the range of 50° to 80° C. for at least about 5 minutes, then chill-setting the emulsion; and step (E) further comprises heating to remelt the chilled emulsion, then adding the iodide salt thereto, and then maintaining the emulsion at a temperature of at least about 40° C. for at least about 5 minutes.

10. A photosensitive element made by the process of claim 1.

11. A photosensitive element made by the process of claim 3.

* * * * *